US008440057B2

(12) United States Patent
Lah

(10) Patent No.: US 8,440,057 B2
(45) Date of Patent: May 14, 2013

(54) LINKED COKE DRUM SUPPORT

(75) Inventor: Ruben F. Lah, South Jordan, UT (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 219 days.

(21) Appl. No.: 12/408,582

(22) Filed: Mar. 20, 2009

(65) Prior Publication Data

US 2009/0236212 A1 Sep. 24, 2009

Related U.S. Application Data

(63) Continuation-in-part of application No. 12/018,468, filed on Jan. 23, 2008.

(51) Int. Cl.

| | |
|---|---|
| ***C10B 55/00*** | (2006.01) |
| ***C10B 29/04*** | (2006.01) |
| ***C10B 29/08*** | (2006.01) |

(52) U.S. Cl.

USPC ..... 202/266; 202/268

(58) Field of Classification Search ..... 202/84, 202/239, 266, 268; 208/131; 196/107, 133; 432/251; 122/510; 220/636

See application file for complete search history.

(56) References Cited

U.S. PATENT DOCUMENTS

| | | | | |
|---|---|---|---|---|
| 899,503 | A * | 9/1908 | Bernhard | 52/67 |
| 1,577,487 | A * | 3/1926 | Otto | 432/251 |
| 1,656,355 | A | 1/1928 | Huffmann | |
| 1,991,621 | A | 2/1935 | Noll | |
| 2,064,567 | A | 12/1936 | Riley | |
| 2,245,554 | A | 6/1941 | Court | |
| 2,317,566 | A | 4/1943 | Utterback | |
| 2,403,608 | A | 7/1946 | Payne et al. | |
| 2,562,285 | A | 7/1951 | Timmer | |
| 2,717,865 | A | 9/1955 | Kimberlin, Jr. et al. | |
| 2,734,715 | A | 2/1956 | Knox | |
| 2,761,160 | A | 9/1956 | Manning | |
| 2,950,897 | A | 8/1960 | Bryant | |
| 3,215,399 | A | 11/1965 | McInerney et al. | |
| 3,367,625 | A | 2/1968 | Fortune | |
| 3,379,623 | A | 4/1968 | Forsyth | |

(Continued)

FOREIGN PATENT DOCUMENTS

| | | |
|---|---|---|
| RU | 2043604 | 10/1995 |

OTHER PUBLICATIONS

J. J. Kelley, "Applied Artificial Intelligence for Delayed Coking", Hydrocarbon Processing, Nov. 2000, 144-A-144-J, Gulf Publishing Company, USA.

(Continued)

*Primary Examiner* — Jill Warden
*Assistant Examiner* — Joye L Woodard
(74) *Attorney, Agent, or Firm* — Kirton McConkie; Michael F. Krieger

(57) ABSTRACT

A linked coke drum connection to minimize the stresses experienced by the joint between the coke drum and the supporting structure of the coke drum is described. The connection may be attached to a circumferential connection plate attached to the coke drum or directly to the drum. Some embodiments connect to a segmented circumferential connection plate. The connection includes a coke drum link, a connecting link, and a ground link. The links are pivotally connected with connecting pins. As the coke drum is heated and expands, the connecting link pivots outwardly about a point centered in the connecting pin in the ground link.

18 Claims, 5 Drawing Sheets

U.S. PATENT DOCUMENTS 3,617,480 A 11/1971 Keel
3,646,947 A 3/1972 Rochelle et al.
3,716,310 A 2/1973 Guenther
3,837,356 A 9/1974 Selep et al.
3,852,047 A 12/1974 Schlinger et al.
4,125,438 A 11/1978 Kelly et al.
4,174,728 A 11/1979 Usnick et al.
4,253,487 A 3/1981 Worley et al.
4,275,842 A 6/1981 Purton et al.
4,335,733 A 6/1982 Richards
4,410,398 A 10/1983 Chipman et al.
RE31,439 E 11/1983 Rosensweig
4,492,103 A 1/1985 Naumann
4,531,539 A 7/1985 Jandrasi et al.
4,611,613 A 9/1986 Kaplan
4,626,320 A 12/1986 Alworth et al.
4,666,585 A 5/1987 Figgins et al.
4,726,109 A 2/1988 Malsbury et al.
4,738,399 A 4/1988 Adams
4,771,805 A 9/1988 Maa
4,773,630 A * 9/1988 Carminati et al. ..... 266/285
4,797,197 A 1/1989 Mallari
4,824,016 A 4/1989 Cody et al.
4,877,488 A 10/1989 Cody et al.
4,923,021 A 5/1990 Courmier et al.
4,929,339 A 5/1990 Elliot, Jr. et al.
4,953,480 A * 9/1990 Collins, Jr. ..... 110/246
4,960,358 A 10/1990 Digiacomo et al.
4,973,386 A 11/1990 Callegari et al.
4,988,411 A * 1/1991 Schroter ..... 202/251
4,993,264 A 2/1991 Cody et al.
5,004,152 A 4/1991 Baker et al.
5,022,266 A 6/1991 Cody et al.
5,022,268 A 6/1991 Wolf et al.
5,024,730 A 6/1991 Colvert
5,035,221 A 7/1991 Martin
5,041,207 A 8/1991 Harrington et al.
5,048,876 A 9/1991 Wallskog
5,059,331 A 10/1991 Goyal
5,107,873 A 4/1992 Clinger
5,116,022 A 5/1992 Genreith et al.
5,221,019 A 6/1993 Pechacek et al.
5,228,525 A 7/1993 Denney et al.
5,228,825 A 7/1993 Fruchtbaum et al.
5,299,841 A 4/1994 Schaefer
5,417,811 A 5/1995 Malsbury
5,464,035 A 11/1995 Heinecke
5,581,864 A 12/1996 Rabet
5,633,462 A 5/1997 Heaslip et al.
5,652,145 A 7/1997 Cody et al.
5,785,843 A 7/1998 Antalffy et al.
5,800,680 A 9/1998 Guerra
5,816,505 A 10/1998 Tran et al.
5,816,787 A 10/1998 Brinkerhoff
5,876,568 A 3/1999 Kindersley
5,891,310 A * 4/1999 Nelsen ..... 201/10
5,907,491 A 5/1999 Canada et al.
5,927,684 A 7/1999 Marx et al.
5,947,674 A 9/1999 Malsbury et al.
5,974,887 A 11/1999 Cody et al.
6,007,068 A 12/1999 Dellacorte
6,039,844 A 3/2000 Malik
6,060,015 A * 5/2000 Kågstrom et al. ..... 266/246
6,066,237 A 5/2000 Kindersley
6,113,745 A 9/2000 Maitland et al.
6,117,308 A 9/2000 Gangi
6,223,925 B1 5/2001 Malsbury et al.
6,228,225 B1 5/2001 Meher-Homji
6,254,733 B1 7/2001 Lu et al.
6,264,797 B1 7/2001 Schroeder et al.
6,264,829 B1 7/2001 Antalffy et al.
6,286,442 B1 * 9/2001 Ranki ..... 110/336
6,367,843 B1 4/2002 Fetzer
6,539,805 B2 4/2003 Heaslip et al.
6,547,250 B1 4/2003 Noble et al.
6,565,714 B2 5/2003 Lah
6,644,436 B2 11/2003 Hofmann et al.
6,644,567 B1 11/2003 Adams et al.
6,660,131 B2 12/2003 Lah
6,738,697 B2 5/2004 Breed
6,751,852 B2 6/2004 Malsbury et al.
6,843,889 B2 1/2005 Lah
6,926,807 B2 8/2005 Bosi et al.
6,964,727 B2 11/2005 Lah
6,989,081 B2 1/2006 Lah
7,033,460 B2 4/2006 Lah
7,037,408 B2 5/2006 Wilborn et al.
7,115,190 B2 10/2006 Lah
7,117,959 B2 10/2006 Lah
7,316,762 B2 1/2008 Lah
7,666,279 B2 * 2/2010 Cihlar et al. ..... 202/239
2002/0134658 A1 9/2002 Lah
2002/0157897 A1 10/2002 Hoffmann et al.
2002/0166862 A1 11/2002 Malsbury et al.
2002/0170814 A1 11/2002 Lah
2003/0047153 A1 3/2003 Kubel et al.
2003/0089589 A1 5/2003 Malsbury
2003/0127314 A1 7/2003 Bell et al.
2003/0159737 A1 8/2003 Stares
2003/0185718 A1 10/2003 Sellakumar
2004/0118746 A1 6/2004 Wilborn et al.
2004/0154913 A1 8/2004 Lah

OTHER PUBLICATIONS

Claudio Allevato & Richard S. Boswell, "Assessing the Structural Integrity and Remaining Life of Coke Drums with Acoustic Emission Testing, Stain Gaging, and Finite Element Analysis," ETCE 99—Symposium on Plant and Facilities Reliability and Mechanical Integrity, 1999 Engineering Source Technology Conference & Exhibition, Stress Engineering Services, Inc.

Paul J. Ellis & Christopher A. Paul, "Tutorial: Delayed Coking Fundamentals," AIChE 1998 Spring National Meeting's International Conference on Refinery Processes Topical Conference Preprints 1998, 1998, Great Lakes Carbon Corporation.

Zappe, R.W., Valve Selection Handbook, Fourth Edition, Gulf Publishing Company, Houston, Texas, (1912) pp. 68-79,158,159,170,171,178,179,186-189.

* cited by examiner

LINKED COKE DRUM SUPPORT

RELATED APPLICATIONS

This application is a continuation in part of U.S. patent application Ser. No. 12/018,468, filed Jan. 23, 2008 titled Coke Drum Skirt.

BACKGROUND OF THE INVENTION

1. Field of the Invention

The present invention relates to a coke drum skirt connection, and more particularly to a connecting system designed to greatly reduce or eliminate the occurrence of low cycle fatigue stresses that typically manifest at and below the circumferential drum to skirt weld of a delayed coker drum as the coke drum expands and contracts during the temperature changes experienced by the coke drum during the delayed coking processes. The described connecting system securely supports the coke drum and prevents tipping of the drum, while allowing thermal contraction and expansion without undue stress to the support system, skirt or drum.

2. Background and Related Art

Many oil refineries recover valuable products from the heavy residual hydrocarbons (commonly referred to as resid or residuum) that remain following initial refining by a thermal cracking process known as delayed coking. The processing of crude oil into gasoline, diesel fuel, lubricants, and the like, as well as many other petroleum-refining operations, produces byproducts. The value of these byproducts can be substantially increased when they are processed by "destructive distillation." During the process of destructive distillation, a portion of the byproducts is converted to usable hydrocarbon products. The remainder is transformed into a solid carbon product called coke. In the refining industry, this process is commonly known as delayed coking.

Generally, the delayed coking process involves heating the heavy hydrocarbon feed from a fractionation unit and then pumping the heated heavy feed into a large steel vessel commonly known as a coke drum. The nongaseous portion of the heated heavy feed settles out in the coke vessel where the combined effect of retention time and temperature causes the formation of coke. Vapors from the top of the coke vessel are returned to the fractionation unit for further processing into desired light hydrocarbon products. The operating conditions of delayed coking can be quite severe. Heavy feed input temperature may vary between 800 degrees Fahrenheit and 1000 degrees Fahrenheit.

Coke drums are typically large, cylindrical vessels commonly 19 to 30 feet in diameter and up to 120 feet tall having a top head and a funnel shaped bottom portion fitted with a bottom head and are usually present in pairs so that they can be operated alternately. The size, shape, and configuration of the coke drum may vary considerably from one installation to another. Coke is formed and accumulates in the vessel until it is filled to a safe margin, at which time the heated feed is switched to the empty "sister" coke vessel. This use of multiple coke drums enables the refinery to operate the fired heater and fractionation tower continuously. Thus, while one coke vessel is being filled with heated residual material, the other vessel is being cooled and cleared of coke (between 500 and 1200 tons) formed in the vessel during the previous recovery cycle. The full vessel is isolated, steamed to remove hydrocarbon vapors, cooled by filling with water, drained, opened, and the coke is drilled out with a water jet for removal out the bottom of the drum. The drums typically operate on a cycle, switching every 10 to 30 hours.

Coke removal begins with a quench step in which steam and then water are introduced into the coke-filled vessel to complete the recovery of volatile, light hydrocarbons and to cool the mass of coke. The vessel is drained, vented to atmospheric pressure, then opened at the bottom for removal of the coke. Removal is typically achieved using a drill bit fed my high pressure water directed through a jet or jets that cut the coke into small pieces which fall out the opened bottom of the coke drum. Once the coke has been removed, the drum is closed, warmed-up, and placed on stand-by, ready to repeat the 10- to 30-hour cycle.

Coke drums are largely vertical, with heights from three to four times their diameters. This large height/diameter ratio makes the coking drums susceptible to tipping due to forces such as those from strong winds, seismic activity, and piping attached to the drum. Further compounding this problem, the coke drums must be elevated to some extent to allow room underneath the coke drums for the dislodged coke to fall out and be removed during the decoking process. This increases the susceptibility of the coke drums to winds and other forces.

A typical coke drum is supported by a skirt which is welded to a lower portion of the drum. The skirt must support the weight of the drum, the coke formed in the drum and the water used to quench the drum. The skirt of the coke drum is typically bolted to a reinforced concrete base that provides the fixed support structure for the drum. This is problematic, however, for the cyclical decoking process subjects the large and heavy coke drum to frequent large temperature fluctuations which cause the drum to expand and contract. The drum is circumscribed by the skirt which expands and contracts at a rate different than the drum. The portion of the skirt that extends outwardly from the drum and which is supported by the supporting structures undergoes stresses often referred to as hoop stress. This can often be exacerbated as the skirt is insulated near the drum and not insulated in the areas farthest away from the drum. By constraining the expansion of the drum, the stresses in the skirt welded connection are incurred both during expansion and contraction of the drum. Some studies suggest that the weld between the skirt and the drum begins to fail from low cycle fatigue at peak stress locations within a few hundred cycles. Stress also occurs in the drum, the bolts and the concrete to which the drum is bolted. The failure of the system securing the coke drum to the concrete base may be gradual, difficult to monitor and costly to inspect.

Recent trends in the coking industry have elevated skirt failure concerns. Economic pressures have encouraged refineries to reduce the cycle times so that more coke may be produced in a given period. Faster production necessitates faster drum quenching causing more rapid cooling of the drum wall causing more stresses on the skirt connection.

BRIEF SUMMARY OF THE INVENTION

A linked coke drum support provides a secure connection between a coke drum and supporting structures to allow for reduced-stress thermal expansion and contraction of the coke drum during operation of the coke drum during the delayed coking/decoking processes. The connection that provides for the reduced-stress thermal expansion and contraction is a pivoting link assembly affixed between the coke drum and supporting structures.

A circumferential connection plate is welded to the outside of the coke drum. This circumferential connection plate is segmented in some embodiments. Bolted or otherwise attached to the circumferential connection plate are a series of coke drum links. Pivotally connected to the coke drum links are connecting links which extend to and pivotally connect with a series of ground links. The ground links are connected to support structures such as one or several concrete or steel walls capable of supporting the weight of the coke drum. In one embodiment, the coke drum links are attached directly to the drum instead of to the circumferential connection plate. In this embodiment, backing plates may be welded to the inside of the drum to improve the strength of the connection.

When the coke drum expands, the circumferential connection plate expands causing the coke drum link to move outwardly. The connecting link, pivotally attached to both the moving coke drum link and the fixed ground link pivots along a shallow arc centered at a pivoting connecting pin joining the connecting link to the ground link. The low friction pivoting of the connecting link allows expansion and contraction of the coke drum to occur without exerting stresses on the connection between the coke drum and the supporting structures. As the connecting links are located about the circumference of the drum, circumferential expansion about the pivot axis is allowed, yet resistance to lateral loads applied to the drum such as wind is provided by those connecting links located normal to the direction of lateral load. The linkage assembly thereby allows the drum to float suspended by the connecting links, yet is still restricted from lateral movement.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Referring now to the Figures, a description of the embodiments of the present invention will be given. It is expected that the present invention may take many other forms and shapes, hence the following disclosure is intended to be illustrative and not limiting, and the scope of the invention should be determined by reference to the appended claims.

Figure 1:
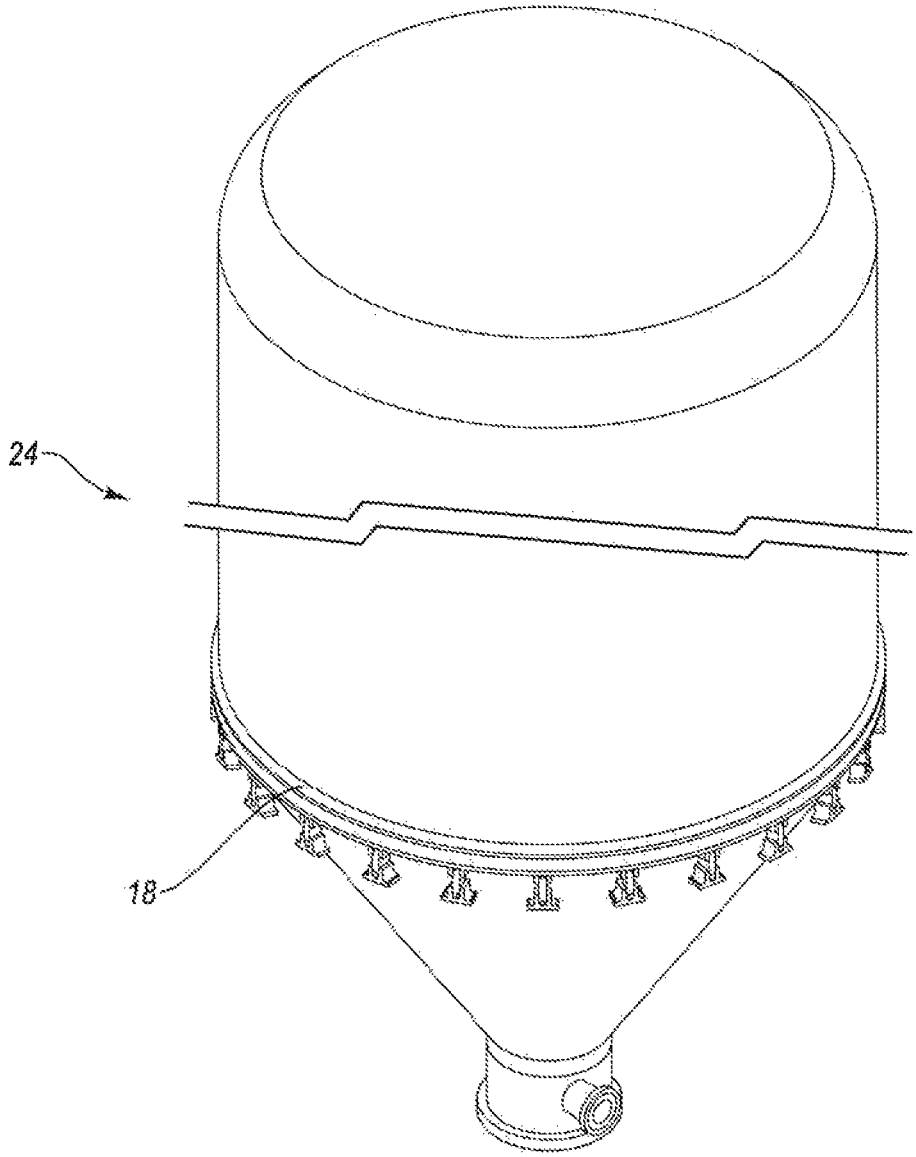
FIG. 1 shows a perspective view of the coke drum with one embodiment of the connecting assembly in place.
Figure 2:
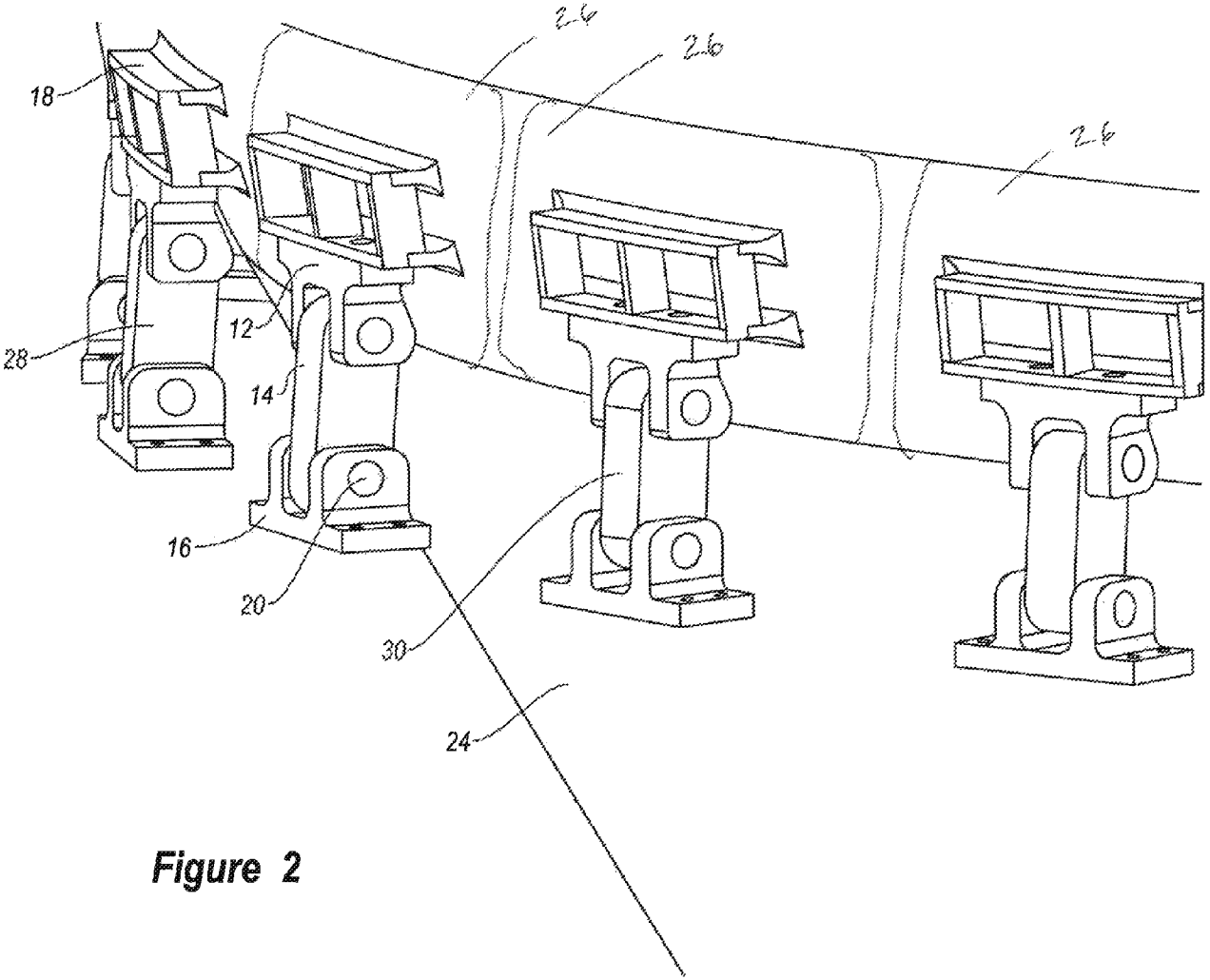
FIG. 2 shows a perspective view of the coke drum with a segmented circumferential connection plate.

In FIG. 1, the linked coke drum connection is shown attached to a coke drum 24. In this embodiment, a circumferential connection plate 18 is welded to the outside of drum 24 and the linked coke drum connection is attached to the connection plate. The linked coke drum connection described herein allows thermal expansion and contraction of the coke drum during the delayed coking processes by providing for a pivoting connection between the coke drum and the supporting structures. As seen in FIG. 2, this pivoting connection in one embodiment comprises a coke drum link 12, and connecting link 14 and a ground link 16. Coke drum link 12 may be attached directly to the drum, or as in this embodiment, is attached by bolts to a circumferential connection plate 18. Links 12, 14, and 16 are pivotally connected at pivot pins 20 and 22. Ground link 16 is attached to support structures capable of bearing the weight of a coke drum 24. As coke drum 24 expands when heated, circumferential connection plate 18 expands moving coke drum link 12 in a direction away from the center of coke drum 24. Connecting link 14, pivotally attached to coke drum link 12 by pivot pin 22 is thereby also pushed in an outward direction. As ground line 16 is affixed to the supporting structures it cannot move so the outward movement of coke drum link 12 and connecting link 14 is translated into a pivoting movement transcribing a shallow arc about pivot pin 20.

The embodiment illustrated in FIG. 2 has a segmented circumferential connection plate 26. This plate serves the same purpose as the circumferential plate illustrated in FIG. 1, but differs in that it is not continuous around the coke drum. It is presently thought that by segmenting the circumferential connecting plate, any stresses that might develop due to different rates of expansion between the coke drum and the circumferential connection plate may be alleviated. It should be understood that the embodiment depicted in FIG. 2 is for illustration purposes only and that segmented circumferential connection plate 26 may not be segmented between each coke drum link 12, but in some embodiments may have several coke drum links attached to each segment.

Figure 3:
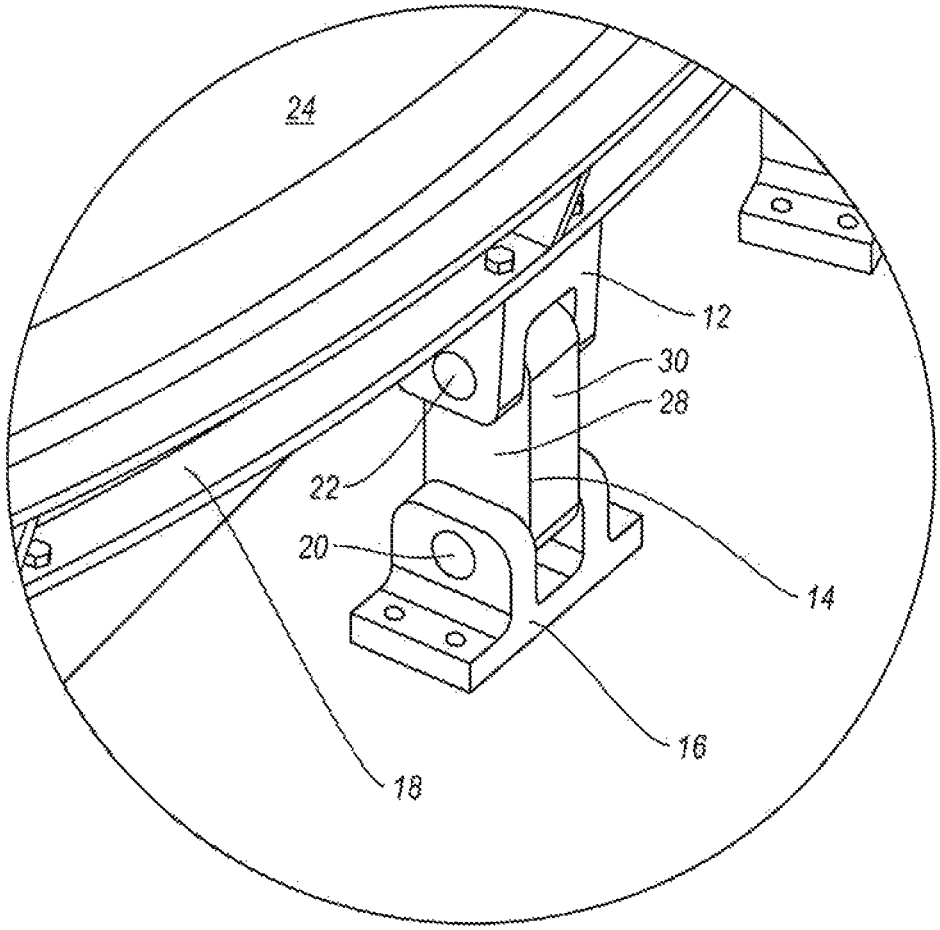
FIG. 3 shows a closer perspective view of one connecting assembly attached to the coke drum.

FIG. 3 depicts in more detail the interconnection of coke drum link 12, connecting link 14 and ground link 16 by connecting pins 22 and 20. In this embodiment coke drum link 12 is bolted to connection plate 18 which is welded to coke drum 24. Ground link 16 is shown with holes drilled in the base thereof for affixation to supporting structures of concrete, steel or other materials capable of supporting coke drum 24. Any known attachment system can be used to attach ground link 16 to the supporting structures including by example and not limitation; welding, bolting or casting ground link 16 into the concrete as it is poured. Connecting link 14 has a link face 28 and a link side 30. Link face 28 and link side 30 must be constructed of materials and have thicknesses sufficient to support coke drum 24 during normal operations as well as resist the movement of coke drum 24 when lateral loads such as wind are applied. Connecting link face 28 and link side 30 must be wide enough and connecting pin 20 thick enough to resist loads normal to the pivoting axis. Similarly, ground link 16 must be securing attached to supporting structures so as to remain attached when lateral loads are placed upon coke drum 24.

Figure 4:
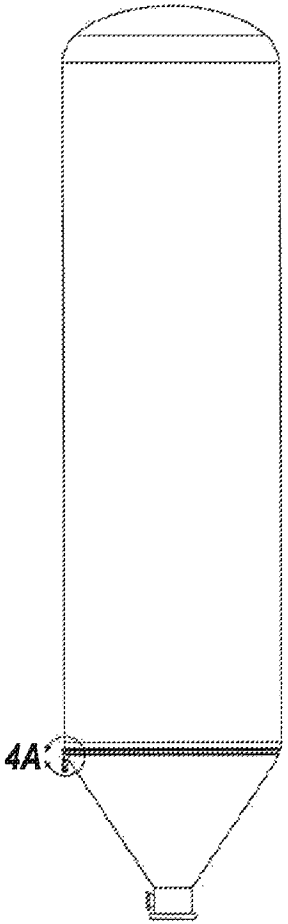
FIG. 4 and FIG. 4A show an elevational view of one embodiment of the connecting assembly attached to a coke drum.
Figure 4A:
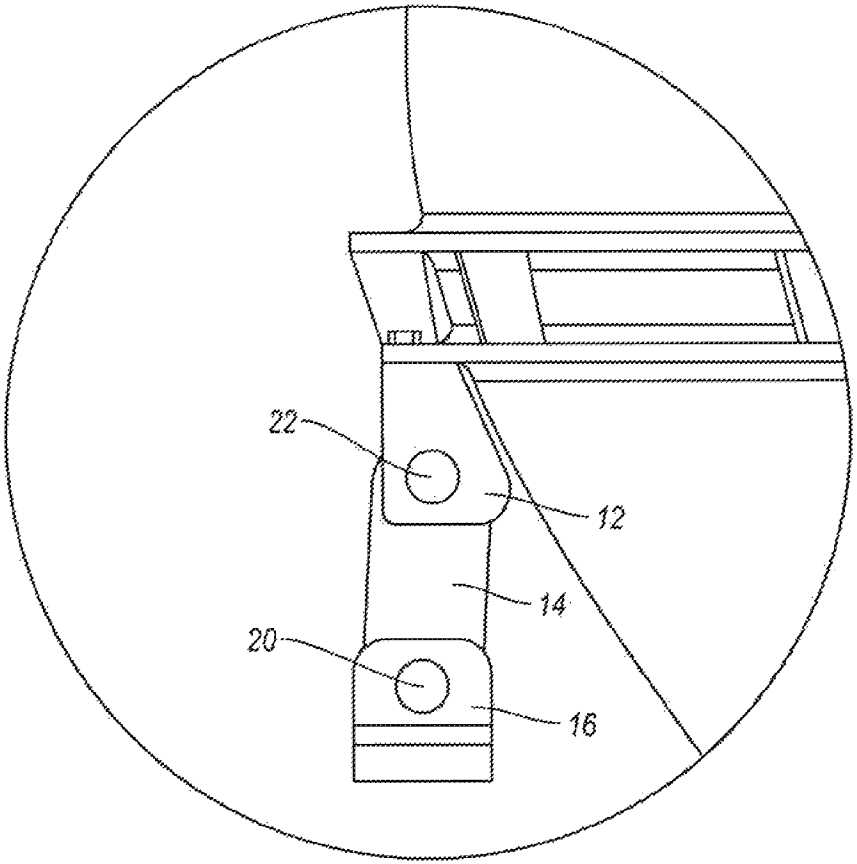

FIG. 4 shows a close view of an embodiment wherein coke drum link 12 has a connecting pin 22 which has an inward offset from the connecting pin 20 located in ground link 16. This inward offset directs the line of force between the two pins toward the weld between coke drum 24 and circumferential connection plate 18. This pin placement greatly reduces any cantilever effect on connection plate 18 thereby exposing circumferential connection plate 18 to less bending force. As coke drum 24 expands, the offset will be reduced and approach a vertical orientation.

Figure 5:
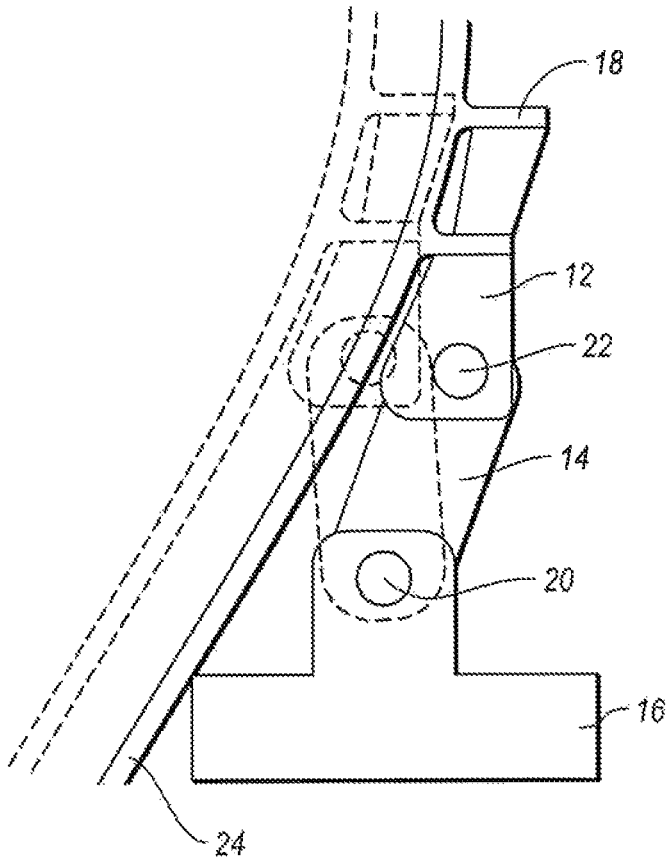
FIG. 5 depicts the movement of the linked coke drum support as the coke drum expands and contracts.

FIG. 5 shows the movement of the linked coke drum support as the drum is heated. The cold state is shown in phantom lines and the heated state is shown in solid lines. Connecting link 14 pivots about connecting pin 22 to allow drum 24 to expand while imparting greatly reduced stress on the fixed supporting structures and the connection between drum 24 and coke drum link 12.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A linked coke drum support providing a secure yet reduced stress connection between a coke drum and a fixed support structure, the linked support comprising:

a fixed support structure capable of supporting the weight of a coke drum during operation of the coke drum; and a pivoting linkage assembly comprising:

a coke drum link attached to a coke drum:

a ground link attached to said support structure; and a connecting link comprising a link face and a link side pivotally attached at one end to said coke drum link and attached at the other end to said ground link.

2. The linked coke drum support as recited in claim 1, further comprising a circumferential connection plate that is segmented and coupled to the coke drum.

3. The linked coke drum support as recited in claim 1, wherein the coke drum link is pivotally connected to the connecting link by a connecting pin and the ground link is pivotally connected to the connecting link by a connecting pins.

4. The linked coke drum support as recited in claim 3, wherein the connecting pins are coated to reduce friction.

5. The linked coke drum support as recited in claim 2, wherein each coke drum link is attached to a separate segment of the segmented circumferential connecting plate.

6. The linked coke drum support as recited in claim 1, further comprising a circumferential connection plate attached to the circumference of the coke drum wherein the coke drum link is attached to the coke drum by the circumferential connection plate.

7. A linked coke drum support providing a secure yet reduced stress connection between a coke drum and a fixed support structure, the linked support comprising:

a bifurcated coke drum link attached to a coke drum and structured to straddle a connecting link; and a bifurcated ground link attached to a support structure and structured to straddle the connecting link, the connecting link pivotally attached at one end to said coke drum link and attached at the other end to said ground link.

8. A linked coke drum support as recited in claim 7, further comprising a segmented circumferential connection plate coupled to the coke drum.

9. A linked coke drum support as recited in claim 7, wherein the coke drum link is pivotally connected to the connecting link by a connecting pin and the ground link is pivotally connected to the connecting link by a connecting pin.

10. A linked coke drum support as recited in claim 9, wherein the connecting pins are coated to reduce friction.

11. A linked coke drum support as recited in claim 8, wherein each coke drum link is attached to a separate segment of the segmented circumferential connecting plate.

12. The linked coke drum support as recited in claim 7, further comprising a circumferential connection plate attached to the circumference of a coke drum wherein the coke drum link is attached to the coke drum by the circumferential connection plate.

13. A linked coke drum support providing a secure yet reduced stress connection between a coke drum and a fixed support structure, the linked support comprising:

a coke drum link comprising a planar surface attached to a circumferential connection plate of a coke drum;

a ground link comprising a planar surface attached to said support structure; and a connecting link comprising a planar surface pivotally attached at one end to said coke drum link and attached at the other end to said ground link, wherein the planar surfaces of the coke drum link, connecting link and ground link are structured to resist lateral loads.

14. A linked coke drum support as recited in claim 13, wherein the circumferential connection plate comprising a segmented circumferential connection plate.

15. A linked coke drum support as recited in claim 13, wherein the coke drum link is pivotally connected to the connecting link by a connecting pin and the ground link is pivotally connected to the connecting link by a connecting pin.

16. A linked coke drum support as recited in claim 15, wherein the connecting pins are coated to reduce friction.

17. A linked coke drum support as recited in claim 14, wherein each coke drum link is attached to a separate segment of the segmented circumferential connecting plate.

18. The linked coke drum support as recited in claim 13, wherein the coke drum link is attached to the coke drum by the circumferential connection plate.

* * * * *